US007543348B2

(12) United States Patent
Le

(10) Patent No.: US 7,543,348 B2
(45) Date of Patent: Jun. 9, 2009

(54) BOTTLE CLEANING DEVICE AND METHODS OF OPERATION

(76) Inventor: Liem Le, 8060 W. Ford Dr., Lakewood, CO (US) 80226

( * ) Notice: Subject to any disclaimer, the term of this patent is extended or adjusted under 35 U.S.C. 154(b) by 787 days.

(21) Appl. No.: 11/064,510

(22) Filed: Feb. 23, 2005

(65) Prior Publication Data

US 2006/0185104 A1 Aug. 24, 2006

(51) Int. Cl.
*A46B 13/02* (2006.01)
*B08B 9/20* (2006.01)
*B08B 9/36* (2006.01)

(52) U.S. Cl. ..... 15/65; 15/22.1; 15/23; 15/59; 15/165

(58) Field of Classification Search ..... 15/65, 15/164, 165, 211, 212, 213, 22.1, 23, 56, 15/59

See application file for complete search history.

(56) References Cited

U.S. PATENT DOCUMENTS 253,884 A * 2/1882 Odell ..... 15/165
609,285 A * 8/1898 Lundgreen ..... 15/56
856,191 A * 6/1907 Boch ..... 15/213
925,909 A * 6/1909 Heywang ..... 15/65
1,014,236 A * 1/1912 Lawhon ..... 15/73
1,536,302 A * 5/1925 Tischer et al. ..... 15/165
1,682,216 A * 8/1928 Dellaree ..... 15/97.1
2,162,677 A * 6/1939 Reynolds ..... 15/104.14
2,209,186 A * 7/1940 Briefer ..... 15/72
2,251,497 A * 8/1941 Reise ..... 15/165
2,696,625 A * 12/1954 Pendleton ..... 15/72
2,922,174 A * 1/1960 Mathews ..... 15/104.095

* cited by examiner

*Primary Examiner*—Randall Chin
(74) *Attorney, Agent, or Firm*—Trenner Law Firm, LLC; Mark D. Trenner

(57) ABSTRACT

Implementations described and claimed herein include bottle cleaning devices and methods. An exemplary bottle cleaning device comprises a drive system. A shaft is releasably connected to the drive system. The shaft rotates in response to operation of the drive system. A brush system is provided on the shaft to rotate in response to operation of the drive system. The brush system includes at least one brush conforming to an inner side-wall of a bottle.

14 Claims, 8 Drawing Sheets

305a
305b
305c
254
360
365
370
280b
275
380
350
385
355

300a
300b
300c
120
330
320
310
220
225
250
252
254
256
270
272
274
275
280a
280b
340a
340b
350
355

BOTTLE CLEANING DEVICE AND METHODS OF OPERATION

TECHNICAL FIELD

The described subject matter relates to cleaning implements, and more particularly to bottle cleaning devices and methods of operation.

BACKGROUND

Bottle cleaning devices are commercially available which include a stiff brush mounted on a rigid, although sometimes flexible, metal or plastic handle. The user typically forces the brush through the bottle opening and manually rotates the handle while sliding it up and down so that the brush contacts and loosens the substance within the bottle which the user desires to remove (e.g., food particles).

In the past, manufacturers have taken a "one-size-fits-all" approach when it comes to bottle cleaning devices. For example, manufacturers have provided cleaning devices with a brush sized to fit well through the opening of one type of bottle (and bottles with minor variations). However, there are so many different bottle configurations that the brush is often sized too large to fit through some bottle openings, while sized too small to effectively clean the inside of other bottles.

In order to accommodate a number of different bottle configurations, some manufacturers have taken to producing many different types of cleaning devices. Accordingly, one cleaning device may be effective for a particular bottle configuration, while another cleaning device may be effective for another bottle configuration. However, this approach requires the consumer to purchase different cleaning devices for nearly every bottle configuration he or she may come across.

SUMMARY

Implementations described and claimed herein provide a bottle cleaning device. An exemplary bottle cleaning device may include a drive system. A shaft is releasably connected to the drive system, the shaft rotating in response to operation of the drive system. A brush system is provided on the shaft to rotate in response to operation of the drive system, the brush system including at least one brush conforming to an inner side-wall of a bottle.

In another exemplary implementation, a system is provided. An exemplary system may include spring-loaded brush means for flexibly engaging and conforming to all inner side-wall of a contoured bottle, and drive means for rotating the brush means.

In another exemplary implementation, a method of operation is provided. The method may include: collapsing a brush, extending the collapsed brush through an opening formed in a container, and automatically expanding the brush within the container by centrifugal force so that the brush conforms to at least one inner side-wall of the container.

DETAILED DESCRIPTION

Figure 1:
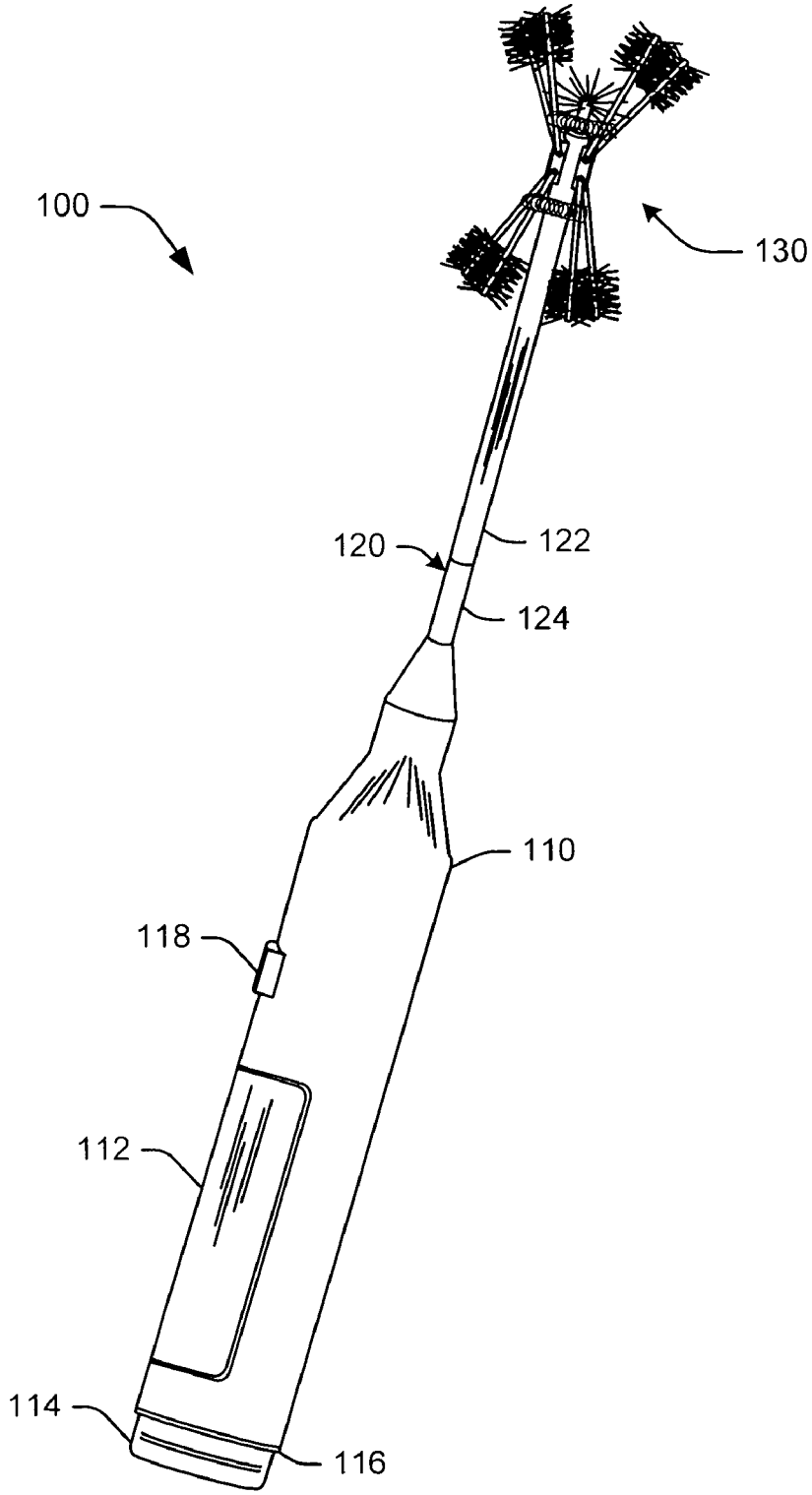
FIG. 1 is a perspective view of an exemplary bottle cleaning device.

FIG. 1 is a perspective view of an exemplary bottle cleaning device. Bottle cleaning device 100 may include a handle portion 110 and a shaft 120 connected to the handle portion 110. A brush system 130 may be provided on the shaft 120.

In an exemplary embodiment, handle portion 110 may be cylindrical in shape, although other configurations are also contemplated. Exemplary handle configurations may also include, but are not limited to, raised "knuckles" and/or curvatures or other ergonomic designs. Handle portion 110 may also include a gripping area 112 for securely grasping the handle portion.

Handle portion 110 may house an electronic drive system, described in more detail below with reference to FIG. 2. The electronic drive system may be powered by one or more batteries, which may be inserted into the handle portion 110 by removing end-cap 114. End-cap 114 may be press fit or screwed into the handle portion 110. In an exemplary embodiment, a gasket 116 (e.g., rubber o-ring) may be provided between the end-cap 114 and the handle portion 110 to seal the electronic drive system and batteries against moisture. In addition, a power switch 118 may also be provided on the handle portion 110. Power switch 118 may be operated by the user to power the electronic drive system on and off.

Shaft 120 may be connected to the handle portion 110 of bottle cleaning device 100. In an exemplary embodiment, shaft 120 may be releasably connected to the handle portion 110. An exemplary connector for releasably connecting the shaft 120 to the handle portion 110 is described in more detail below with reference to FIG. 4. Although releasably connecting the shaft 120 to the handle portion 110 enables a user to readily replace the shaft 120 (and brush system 130) without having to also replace the handle portion 110 (and drive system shown in FIG. 2), the bottle cleaning device 100 is not limited to use with a releasably connected shaft.

Shaft 120 may also be extendable. In an exemplary embodiment, shaft 120 may include a plurality of hollow cylinders (e.g., cylinders 122 and 124) fitted within one another such that the user can pull the cylinders apart to extend the shaft 120, and push the cylinders together to collapse the shaft 120, much like automobile radio antennas. Other embodiments for extending and collapsing the shaft 120 are also contemplated, as will be readily apparent to one having ordinary skill in the art after having become familiar with the teachings shown and described herein.

Handle portion 110 and shaft 120 may be made from any of a wide variety of materials, e.g., plastic or other polymer material (although metal and metal alloys may also be used). In an exemplary embodiment, handle portion 110 and shaft 120 are both manufactured by a plastic injection-molding process. It is noted, however, that handle portion 110 and shaft 120 do not need to be manufactured of the same materials. For example, handle portion 110 may be manufactured from a stiff plastic material while shaft 120 may be manufactured from a flexible plastic material, or vice versa.

It is noted that although use of a flexible material may enable the brush system to better conform to the surface being cleaned, bottle cleaning device 100 is not limited to a flexible handle portion 110 or a flexible shaft 120.

Brush system 130 may include one or more brushes, movably attached to the shaft 120. Brush system 130 is described in more detail below with reference to FIGS. 5, 5*a*, and FIGS. 6*a-b*. For now it is enough to understand that the brush system 130 moves automatically by means of an electronic drive system which will now be described with reference to FIG. 2.

Figure 2:
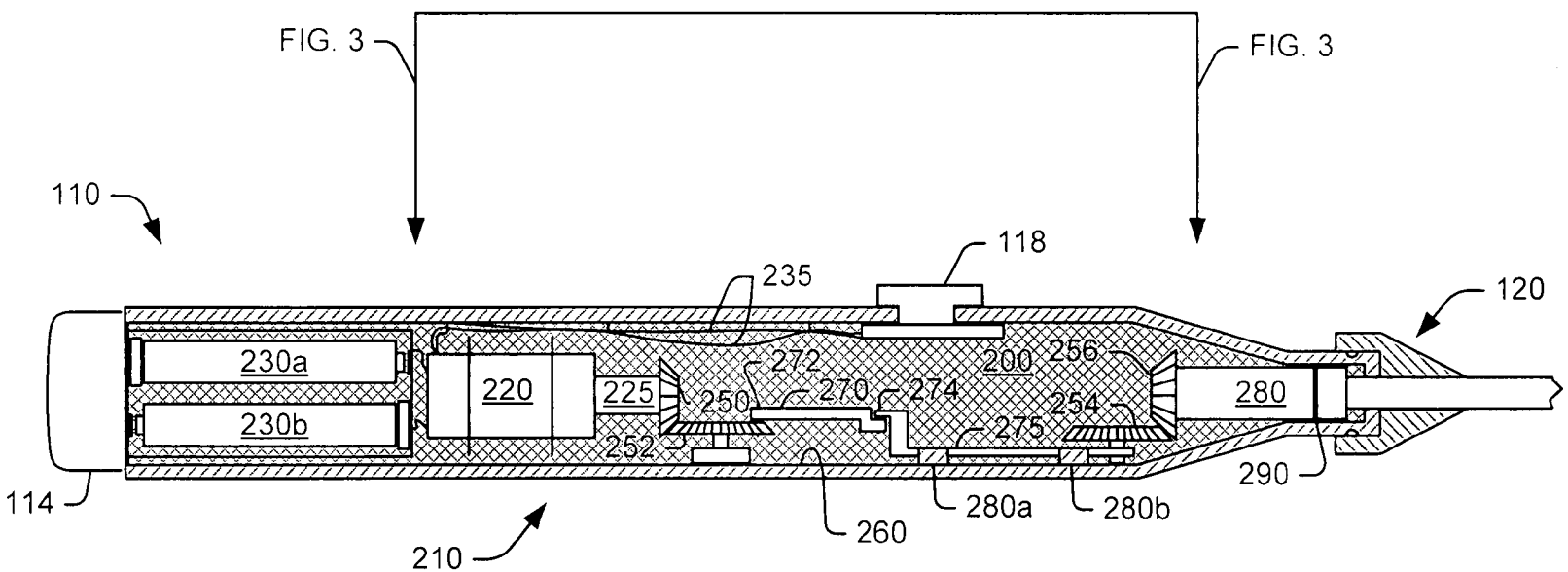
FIG. 2 is cross-sectional view of the handle portion of an exemplary bottle cleaning device.

FIG. 2 is cross-sectional view of the handle portion of an exemplary bottle cleaning device. As discussed above, handle portion 110 may include a cavity 200 formed therein to house a drive system 210.

Drive system 210 may include an electric motor 220 powered by one or more batteries 230*a,b*. Switch 118 may extend through the handle portion 110 and into cavity 200. Electrical wiring 235 may connect the switch 118 to the electric motor 220 to power the electric motor 220 on and off.

In all exemplary embodiment, a 10 amp electric motor may be powered by two 1.5 volt AA batteries. However, it is noted that the type and rating of electric motor 220 will depend at least to some extent on design considerations. Exemplary design considerations may include, but are not limited to, the size of shaft 120 and brush system 130 (FIG. 1), the desired rotational speed, cost, and desired durability. Likewise, the number and voltage rating of batteries 230 may also depend on design considerations, such as, e.g., the power requirements for electric motor 220.

Drive system 210 may also include one or more gears and linkages connecting the electric motor 220 to the shaft 120. In the exemplary embodiment shown in FIG. 2, electric motor 220 may include a rotatable drive shaft 225. A drive gear 240 is mounted on drive shaft 225 to rotate with the drive shaft 225. Drive gear 240 engages a first gear 250, e.g., rotationally mounted to the interior wall 260 of handle portion 110 in a plane substantially perpendicular to the drive gear 250.

Also in this exemplary embodiment, a first link arm 270 is pivotally connected on one end to the first gear 252, e.g., by pin 272, and on the opposite end of the first link arm 270 to one end of a second link arm 275, e.g., by pin 274. The second link arm 275 may be slidably seated between one or more guide members 280*a,b* to discourage twisting of the second link arm 275 that may be caused by rotational movement of the first link arm 270, as shown in more detail in FIG. 3.

Further in this exemplary embodiment, the second link arm 275 is operatively associated with a second gear 254, as described in more detail below with reference to FIGS. 3 and 3*a*. Second gear 254 may be rotationally mounted to the interior wall 260 of handle portion 110 in a plane substantially parallel to the first gear 252. Second gear 254 is operatively associated with a third gear 256, e.g., provided on shaft 120 in a plane substantially perpendicular to both the first gear 252 and second gear 254. An exemplary embodiment for operatively associating the second gear 254 with the third gear 256 is described in more detail below with reference to FIG. 3*a*. For now it is sufficient to understand that rotation of the second gear 254 during operation of the drive motor 220 may cause the third gear 256 (and hence shaft 120) to pivot back and forth (e.g., clockwise and then counter-clockwise).

A portion of shaft 120 is also shown in FIG. 2, extending into cavity 200 and coupled to drive system 210. Shaft 120 may be coupled to drive system 210 via a connector 280. An exemplary connector 280 is described in more detail below with reference to FIGS. 4 and 4*a*. A gasket 290 (e.g., rubber o-ring) may also be provided between the handle portion 110 and the shaft 120 to seal the electronic device system 210 and batteries 230*a,b* against moisture.

Figure 3A:
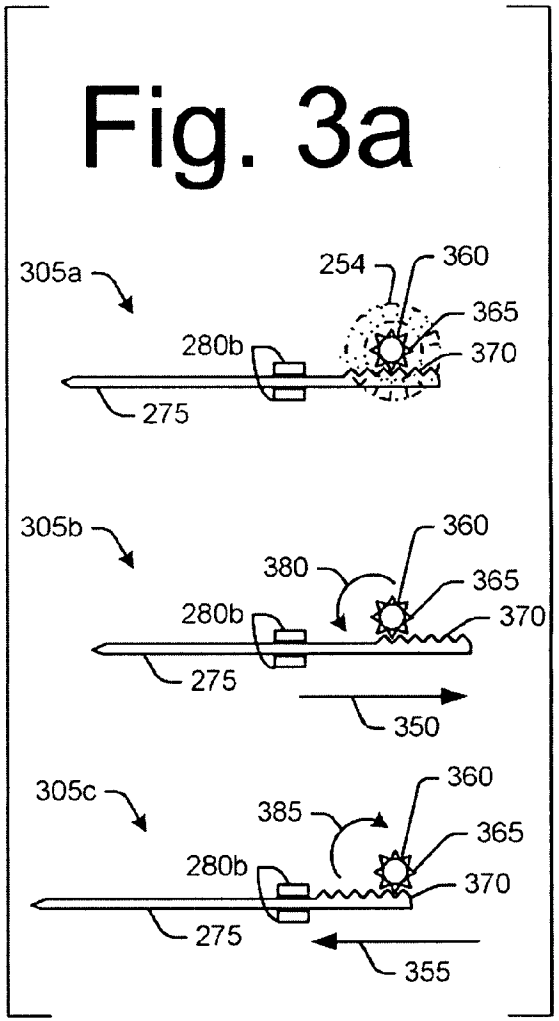
FIG. 3*a* shows a portion of the drive system which is partially hidden in FIG. 3.
Figure 3:
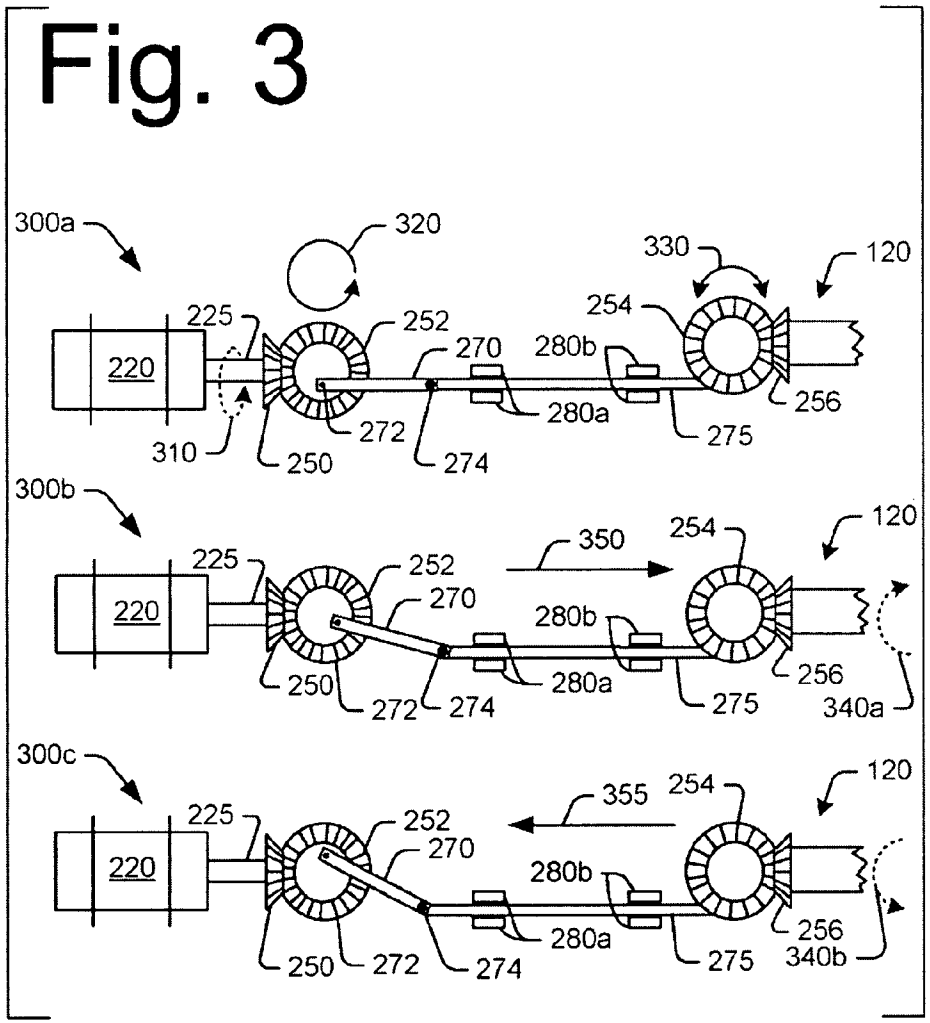
FIG. 3 illustrates operation of an exemplary drive system.

FIG. 3 illustrates operation of an exemplary drive system. In FIG. 3, the drive system is shown looking in the direction of the arrows labeled 3-3 in FIG. 2. Also in FIG. 3, three "snapshots" show the same drive system at different stages of operation. The snapshots are referred to as 300*a-c*, respectively. It is noted that the handle portion is not shown in FIG. 3 to focus attention on the drive system itself.

For purposes of illustration, electric motor 220 is shown in snapshot 300*a* rotating the drive shaft 225 in a counter-clockwise direction 310 (although it will be readily appreciated that the electric motor 220 may also rotate drive shaft 225 is a clockwise direction). Rotating drive shaft 225 in a counter-clockwise direction also rotates drive gear 250 in a counter-clockwise direction 310.

The rotation of drive gear 250 in a counter-clockwise direction 310 rotates first gear 252 in a counter-clockwise direction 320. As first gear 252 rotates, link arm 270 pivots about the first gear 252 at pin connection 272, as shown in snapshot 300*b* and snapshot 300*c*.

Movement of link arm 270 causes link arm 275 to move in a back and forth (or up/down) motion. The back and forth motion is illustrated by arrow 350 in snapshot 300*b* and arrow 355 in snapshot 300*c*. Guide members 280*a,b* discourage twisting of the second link arm 275 that may be caused by rotational movement of the first link arm 270 and help maintain the motion of link arm 275 in the directions of arrows 350, 355.

The back and forth motion of link arm 275 causes second gear 254 to pivot back and forth in the direction of arrows 330. The pivoting motion of second gear 254 is translated to a pivoting motion of third gear 256, and hence shaft 120, as illustrated by arrows 340*a* and 340*b*.

The pivoting motion of shaft 120 can be better understood with reference to FIG. 3*a*. FIG. 3*a* shows a portion of the drive system which is partially hidden in FIG. 3. Again, three "snapshots" show the same portion of the drive system at different stages of operation. The snapshots are referred to as 305*a-c*, and each corresponds to the snapshots 303*a-c*, respectively, in FIG. 3.

Link arm 275 may engage a fourth gear 360 not shown in FIG. 3 because it is "hidden" behind the third gear 254 (third gear 254 is shown in snapshot 305*a* in FIG. 3*a* in dashed format to orient the reader). Fourth gear 360 may be fixedly attached (or formed integrally therewith) to third gear 256 so that rotation of fourth gear 360 translates directly to rotation of the third gear 256.

Fourth gear 360 may include teeth 365, which may be engaged by teeth 370 attached to (or formed on) link arm 275. Accordingly, movement of the link arm 275 in the back and forth directions of arrows 350, 355 cause the fourth gear 360 to pivot first in one direction, and then in the opposite direction.

The pivoting motion of gear 360 is shown in more detail in the snapshots 305*b* and 305*c*. That is, as the link arm 275 moves in the direction of arrow 350, as shown in snapshot 305*b*, fourth gear 280 rotates counter-clockwise in the direction illustrated by arrow 380. As the link arm 275 moves in the direction of arrow 355, as shown in snapshot 305*c*, fourth gear 280 rotates clockwise in the direction illustrated by arrow 385. This pivoting motion of gear 360 is translated directly into a pivoting or "back and forth" motion of shaft 120 by way of second gear 254 and fourth gear 256.

It is noted that although operation of the exemplary drive system 210 in FIG. 2 is illustrated in FIG. 3, that the bottle cleaning device 100 (FIG. 1) is not limited to any particular implementation. Other embodiments of drive system 210 will also become readily apparent to one having ordinary skill in the art after having become familiar with the teachings of the invention. For example, other embodiments may include a drive motor which is operable to directly drive the shaft in a back and forth pivoting motion such as described for the drive system 210. In other embodiments, a drive system may be implemented wherein the shaft is rotated, as opposed to pivoted in the back and forth manner described for the drive system 210.

Figures 4, 4A:
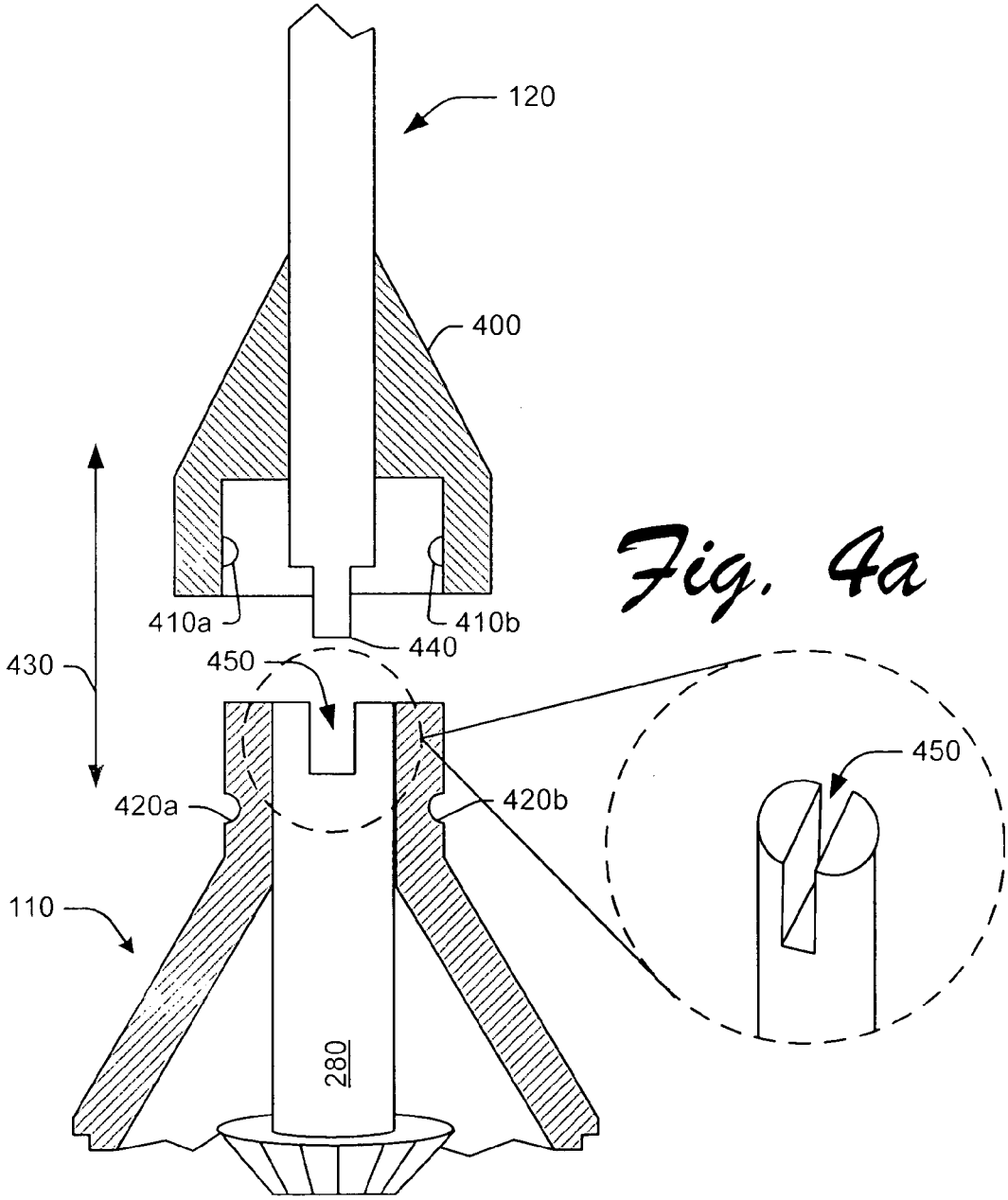
FIG. 4 is a cross-sectional view of an exemplary connector for a bottle cleaning device.
FIG. 4*a* is a perspective view detailing the portion highlighted in FIG. 4.

FIG. 4 is a cross-sectional view of an exemplary connector for a bottle cleaning device. In an exemplary embodiment, shaft 120 may include a cap portion 400 attached to (or formed on) the shaft 120. Shaft 120 may be releasably connected to (or disconnected from) the handle portion 110 by aligning the cap portion 400 over the end of handle portion 110 and moving the two pieces together (or pulling the two pieces apart) as illustrated by arrow 430. Protrusions 410*a*, 410*b* engage mating indentations 420*a*, 420*b* formed in the handle portion 110 when the shaft 120 is connected to the handle portion 110. Accordingly, the shaft 120 may be "locked" to connector 280.

In an exemplary embodiment, an extension 440 may be provided on one end of the shaft 120, and slidably engages a mating slot 450 formed in the connector 280, as shown in more detail in FIG. 4*a*. Accordingly, rotation of the connector 280, e.g., by drive system 210, also results in rotation of the shaft 120.

It is noted that other embodiments for connector 280 are also contemplated and are not limited to the connector 280 described with reference to FIG. 4. For example, shaft 120 may be threaded to engage corresponding threading in connector 280 (e.g., similarly to a screw and nut engagement). Indeed, in other embodiments, the shaft 120 may be permanently mounted to the handle portion 110 of bottle cleaning device 100 (FIG. 1).

Figure 5:
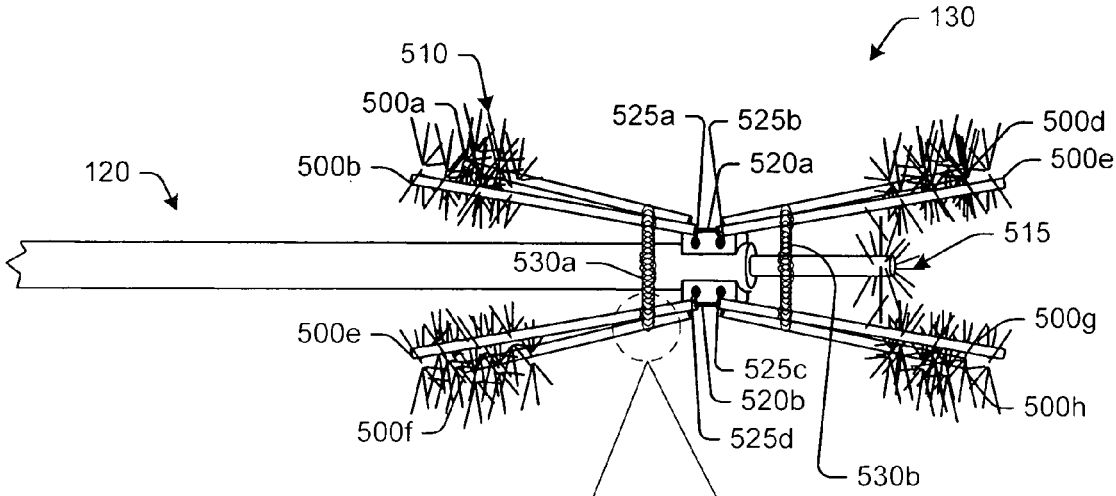
FIG. 5 is a perspective view of an exemplary brush system for a bottle cleaning device.

FIG. 5 is a perspective view of an exemplary brush system for a bottle device. Brush system 130 may include one or more brush arms 500*a-h* pivotally mounted to the shaft 120, each brush arm 500*a-h* having a plurality of brush bristles 510. At least one brush 515 may also be provided on an end of the shaft 120 (e.g., for cleaning the bottom of a bottle).

Although four brush arms are shown for purposes of illustration in the figures, embodiments are also contemplated with more than four brush arms and other embodiments are also contemplated with fewer than four brush arms. It is also noted that any type and configuration of brush bristles may be provides on the brush arms, and are not limited to the type and/or configuration of brush bristles shown in the drawings.

In an exemplary embodiment, brush arms 500*a-h* (referred to generally hereinafter as brush arms 500) may be pivotally mounted to the shaft 120 at connecting blocks 520*a,b* by pins 520*a-d* (or other connection means). The brush arms 500 may be maintained in a collapsed position about the shaft 120 (as shown in FIG. 5) by spring 530*a,b*. During operation, the springs may expand to allow the brush arms 500 to pivot away from the shaft 120 and engage the interior surfaces of a bottle for cleaning operations, as described in more detail below with reference to FIGS. 6*a-b* and 7*a-b*.

It will be readily appreciated by those having ordinary skill in the art after having become familiar with the teachings disclosed herein that the springs 530*a,b* may be selected based on various design considerations. Exemplary design considerations may include, but are not limited to, the size and weight of brush arms 500, rotation of the shaft 120 provided by the drive system 210 (FIG. 2), ability to resist rust and corrosion, and cost. It is also noted that the bottle cleaning device 100 (FIG. 1) is not limited to use with springs, and other components which provide the same or similar function may also be implemented, such as, e.g., elastic straps or bands.

Figure 5A:
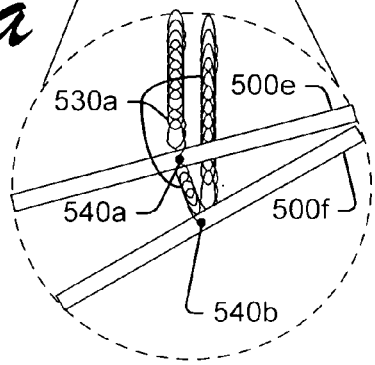
FIG. 5*a* shows in detail the portion highlighted in FIG. 5.

Each spring (e.g., spring 530*a*) is a continuous spring component which wraps around all of the brush arms (e.g., spring 530*a* wraps around brush arms 500*a,b* and 500*e,f*). Attachment of the springs is shown in FIG. 5*a*. FIG. 5*a* shows in detail the portion highlighted in FIG. 5. The spring 530*a* extends through an opening 540*a* formed in brush arm 500*e* and through an opening 540*b* formed in brush arm 500*f*. Similar openings (not shown) may also be formed in brush arms 500*a,b* to keep spring 530*a* from sliding off the brush arms 500 during operation.

Figure 6A:
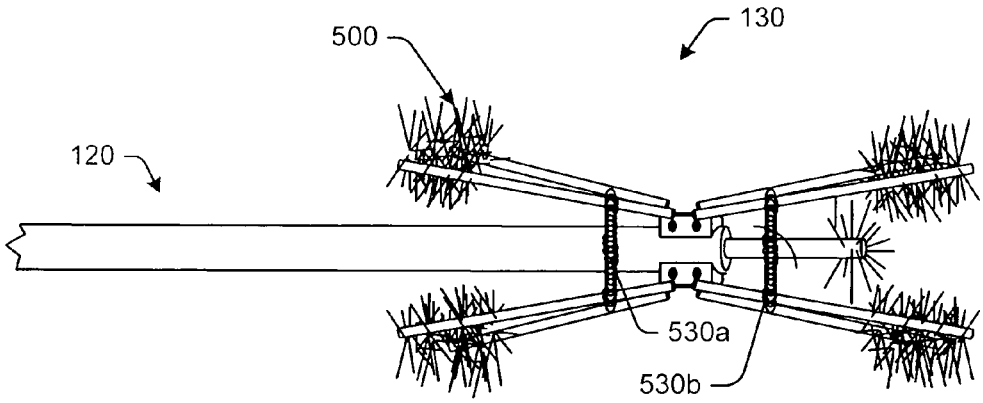
FIGS. 6*a* and 6*b* illustrate operation of an exemplary brush system.
Figure 6B:
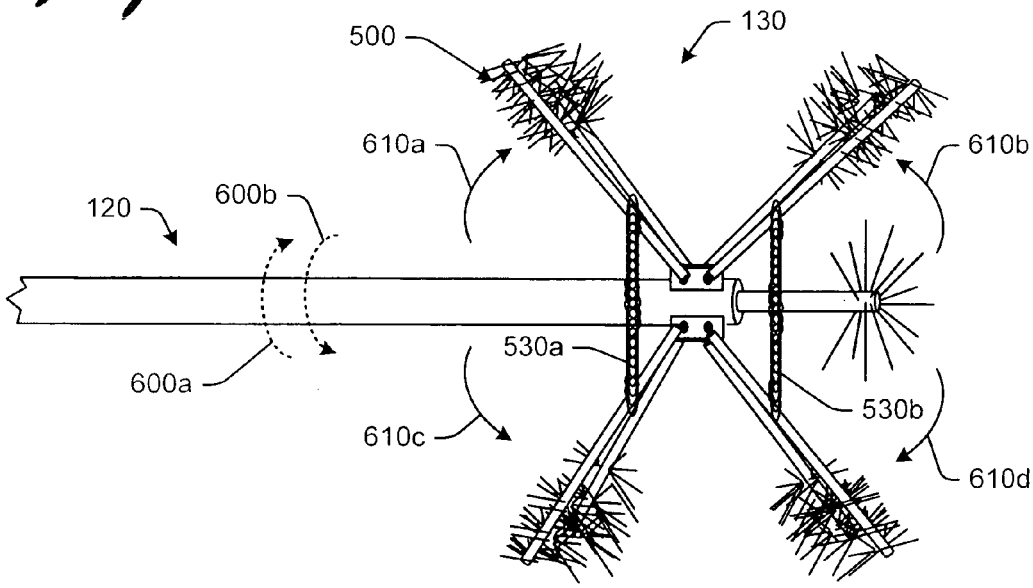

FIGS. 6*a* and 6*b* illustrate operation of an exemplary brush system. In FIG. 6*a*, the brush arms 500 are shown in a collapsed position about the shaft 120, such as may be the case when the drive system is powered off (i.e., there is little or no rotation of shaft 120).

In FIG. 6*b*, the brush arms 500 are shown in an extended position, i.e., moved away from the shaft 120. When the drive system is powered on, the shaft 120 moves in the direction indicated by arrows 600*a,b* (e.g., as described above for operation of the drive system 210). This motion of shaft 120 results in a rotational (centrifugal) force on the brush arms 500 which causes the brush arms 500 to pivot away from the shaft against the force of springs 530*a,b*, e.g., in the directions illustrated by arrows 610*a-d*. When the drive system is powered off, the shaft 120 slows and eventually stops moving, and the force of the springs on brush arms 500 cause the brush arms 500 to collapse about the shaft 120 (e.g., as shown in FIG. 6*a*).

Figure 7A:
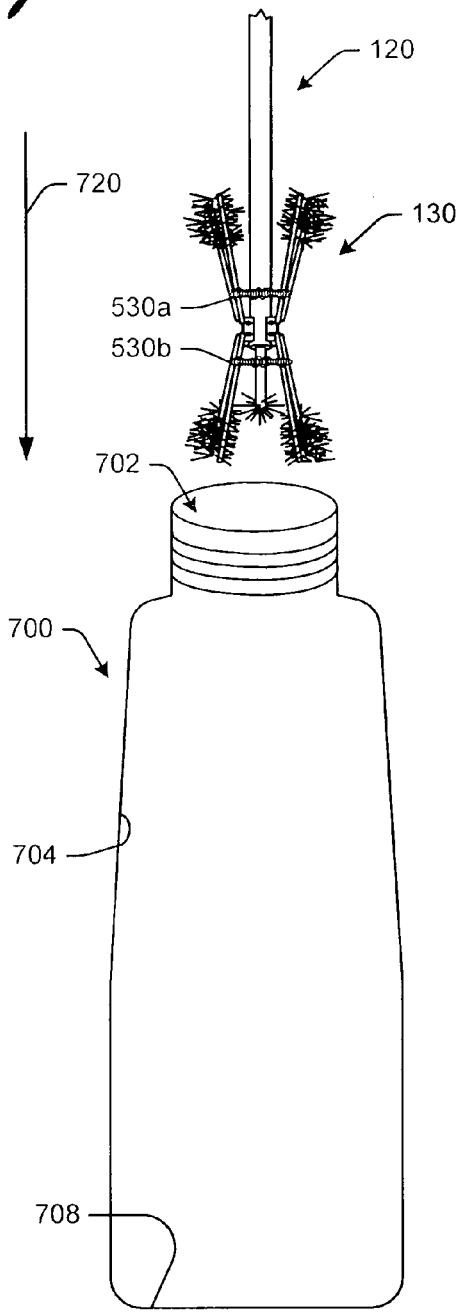
FIGS. 7*a* and 7*b* illustrate an exemplary brush system as it may be fitted into a bottle for cleaning operations.
Figure 7B:
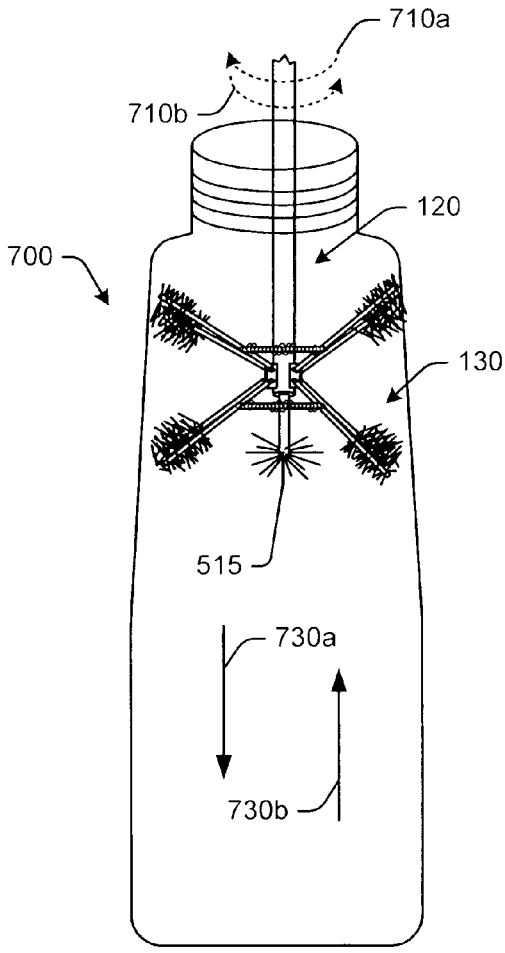

FIGS. 7*a* and 7*b* illustrate an exemplary brush system as it may be fitted into a bottle for cleaning operations. In FIG. 7*a*, the brush system 130 is shown in a collapsed position about the shaft 120 (e.g., as described above with reference to FIG. 6*a*). Accordingly, the brush system 130 may readily be inserted into the bottle 700 in the direction indicated by arrow 720 through an opening (or "mouth") 702 formed in the bottle 700.

In FIG. 7*b*, the brush system 130 is shown positioned inside the bottle 700. The brush system 130 may then be powered on so that the drive system (e.g., drive system 210 in FIG. 2) moves the shaft 120, e.g., as illustrated by arrows 710*a,b*. Movement of the shaft 120 causes the brush system 130 to expand within the bottle 700, e.g., as described above with reference to FIG. 6*b*. As the brush system 130 expands, the brushes come into contact with the interior of the bottle 700.

During operation, the brush system 130 may flexibly engage (or conform to) various contours 704, 708 of bottle 700, enabling the user to effectively clean the interior surfaces of the bottle. The user may also move the bottle cleaning device 100 (FIG. 1) in the directions indicated by arrows 720*a, b*, while maintaining the brush system 130 within the bottle, to effectively clean the interior length of the bottle 700.

Alternative Brush System

Figure 8A:
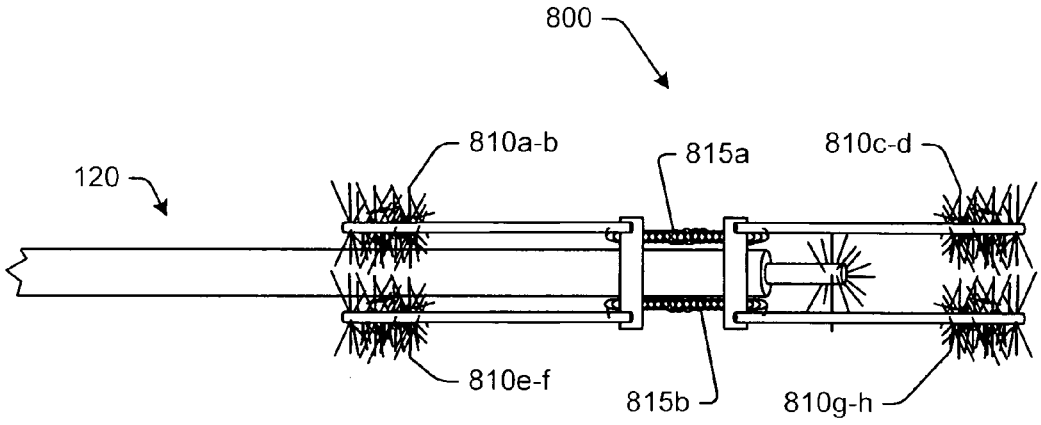
FIGS. 8*a* and 8*b* illustrate an alternative brush system which may be used with the bottle cleaning device.
Figure 8B:
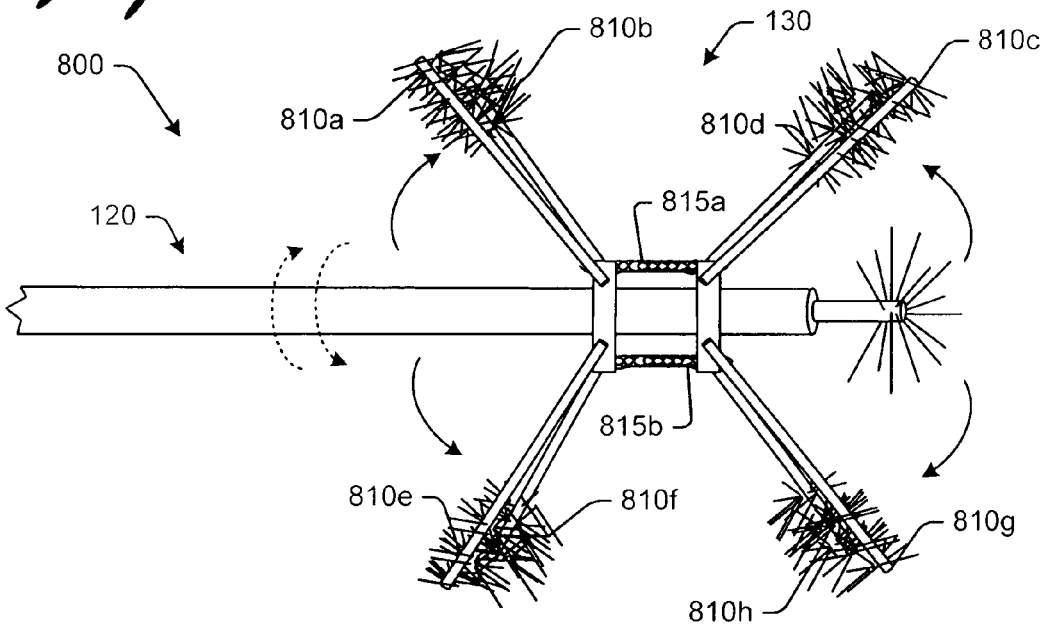

FIGS. 8*a* and 8*b* illustrate an alternative brush system 800 which may be used with the bottle cleaning device 100. Exemplary brush system 800 may include brush arms 810*a-h* (generally referred to as 810) pivotally connected to shaft 120 on supports 812. Springs 815 (or other elastic material) extends between oppositely arranged brush arms (e.g., 810*a, b* and 810*c, d*).

As described above with reference to operation of brush system 130, the brush arms 810 are in a collapsed position about the shaft 120 when the bottle cleaning device 100 is powered off (FIG. 8*a*). During operation, the brush arms 810 move to an extended position, i.e., away from the shaft 120 (FIG. 8*b*).

Although exemplary embodiments are described herein as the bottle cleaning device may be used to clean bottles, it should be understood that the scope of the invention is not limited to use for cleaning bottles and may be implemented to clean many different types containers or vessels.

In addition to the specific embodiments explicitly set forth herein, other aspects will be apparent to those skilled in the art from consideration of the specification disclosed herein. It is intended that the specification and illustrated embodiments be considered as examples only, with a true scope and spirit of the following claims.

The invention claimed is:

1. A bottle cleaning device comprising:

a drive system;

a shaft releasably connected to the drive system, the shaft pivoting back-and-forth in response to operation of the drive system; and a brush system including at least one brush provided on the shaft, the brush system automatically expanding in response to operation of the drive system; and wherein the drive system includes:

a motor operable to rotate a first gear;

a second gear operatively associated with the shaft;

a link arm pivotally connected on one end to the first gear and on an opposite end to the second gear, the link arm translating rotation of the first gear to the second gear for generating the back-and-forth pivoting motion of the shaft.

2. The bottle cleaning device of claim 1, further comprising a handle having a waterproof cavity formed within the handle to house the drive system.

3. The bottle cleaning device of claim 1, wherein the brush system is removable by releasing the shaft from the drive system.

4. The bottle cleaning device of claim 1, wherein the at least one brush is spring-loaded to expand.

5. The bottle cleaning device of claim 1, wherein the shaft is flexible.

6. The bottle cleaning device of claim 1, wherein the brush system includes:

at least one arm pivotally mounted to the shaft, the at least one arm having the at least one brush;

a spring collapsing the at least one arm about the shaft so that the shaft is extendible through an opening formed in a bottle.

7. The bottle cleaning device of claim 6, wherein the spring releases the at least one arm to expand during operation of the drive system.

8. The bottle cleaning device of claim 1, wherein the brush system includes at least one brush positioned on an end of the shaft.

9. The bottle cleaning device of claim 1, wherein the brush system includes at least two upper brushes and at least two lower brushes.

10. The bottle cleaning device of claim 1, further comprising a third gear connected to a drive shaft on the motor, the third gear engaged by the first gear.

11. The bottle cleaning device of claim 10, wherein the third gear is in a plane perpendicular to the first gear.

12. The bottle cleaning device of claim 1, further comprising a fourth gear connected to the brush system, the fourth gear engaged by the second gear.

13. The bottle cleaning device of claim 12, wherein the fourth gear is in a plane perpendicular to the second gear.

14. The bottle cleaning device of claim 12, wherein the shaft is extendible.

* * * * *